US005684494A

United States Patent [19]

Nathrath et al.

[11] Patent Number: 5,684,494

[45] Date of Patent: Nov. 4, 1997

[54] REFLECTOR ANTENNA, ESPECIALLY FOR A COMMUNICATIONS SATELLITE

[75] Inventors: Norbert Nathrath, Taufkirchen; Helmut Wolf, Holzkirchen; Ludwig Haas, Putzbrunn; Manfred Lieke, Ebersberg; Detlev Blaschke, Grosshelfendorf, all of Germany

[73] Assignee: Daimler-Benz Aerospace AG, Germany

[21] Appl. No.: 574,444

[22] Filed: Dec. 15, 1995

[30] Foreign Application Priority Data

Dec. 15, 1994 [DE] Germany ..... 44 44 724.8
Dec. 15, 1994 [DE] Germany ..... 44 44 725.6

[51] Int. Cl.[6] ..... H01Q 13/00

[52] U.S. Cl. ..... 343/781 P; 343/761; 343/781 CA; 343/786; 343/840

[58] Field of Search ..... 343/761, 781 P, 343/781 R, 786, 839, 840; H01Q 13/00, 19/10, 19/12

[56] References Cited

U.S. PATENT DOCUMENTS

| | | | |
|---|---|---|---|
| 3,277,490 | 10/1966 | Williams | 343/761 |
| 3,939,480 | 2/1976 | Lewis | 343/761 |
| 4,274,098 | 6/1981 | Renau et al. | 343/839 |
| 4,305,075 | 12/1981 | Salvat et al. | 343/781 CA |
| 4,312,002 | 1/1982 | Stewart | 343/761 |
| 4,338,607 | 7/1982 | Drabowitch | 343/781 CA |
| 4,574,287 | 3/1986 | Waters | 343/761 P |
| 4,647,939 | 3/1987 | Roederer | 343/756 |
| 4,668,955 | 5/1987 | Smoll | 343/781 CA |
| 4,939,526 | 7/1990 | Tsuda | 343/781 CA |
| 5,198,827 | 3/1993 | Seaton | 343/781 CA |

*Primary Examiner*—Hoanganh T. Le
*Assistant Examiner*—Tan Ho
*Attorney, Agent, or Firm*—Evenson, McKeown, Edwards & Lenahan P.L.L.C.

[57] ABSTRACT

The invention provides a reflector antenna, especially for a communications satellite, having at least one fixed main reflector (102) with an essentially circular aperture. A fixed feed system (118) includes a horn radiator (108) with a rotationally symmetric radiation diagram and a fixed polarization direction. An auxiliary reflector may be arranged to be rotationally positionable around a main axis (E) and has a reflecting surface that is shaped as a partial surface of a nonrotationally symmetric ellipsoid with a low numerical eccentricity, which illuminates main reflector (102) elliptically with an ellipticity that is essentially constant regardless of the rotational position.

10 Claims, 3 Drawing Sheets

Fig.1
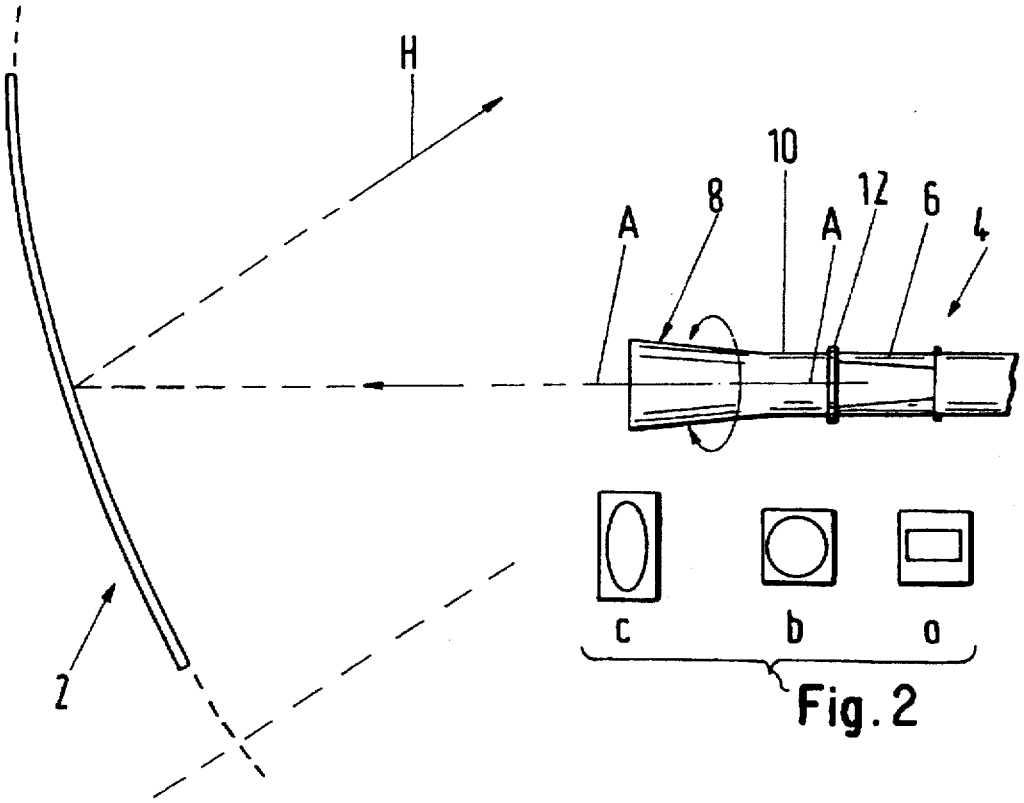
Fig. 2
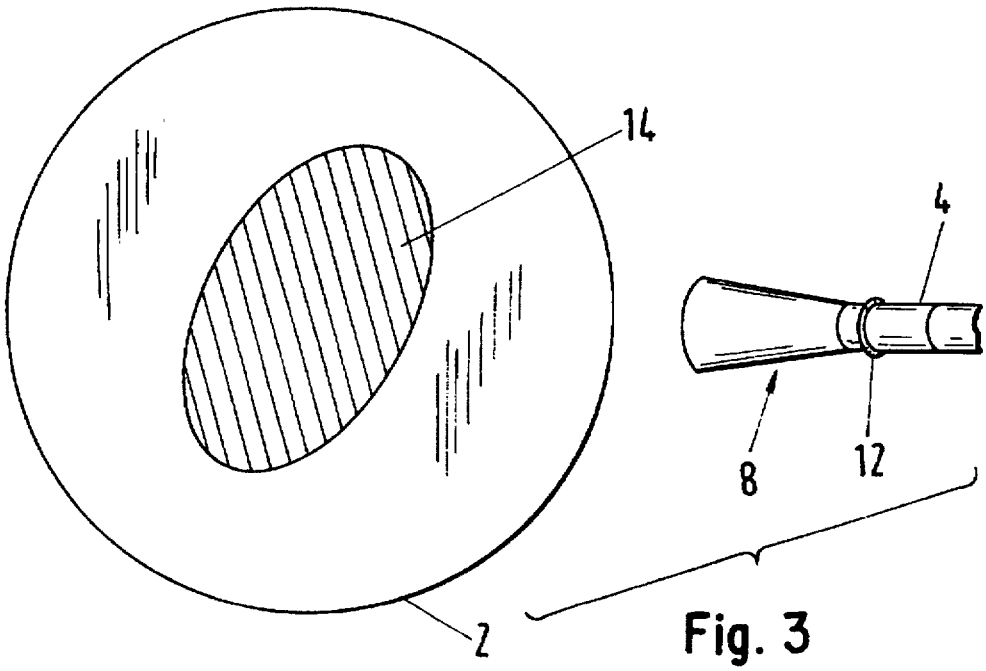
Fig. 3

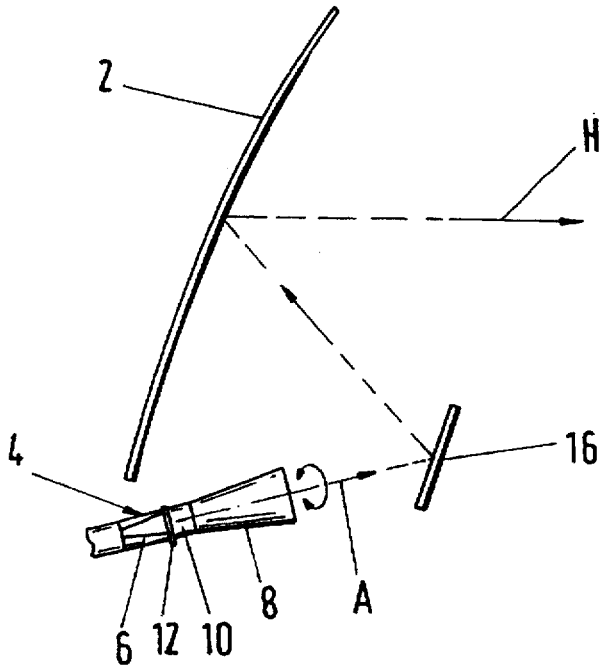
Fig. 4
Fig. 5
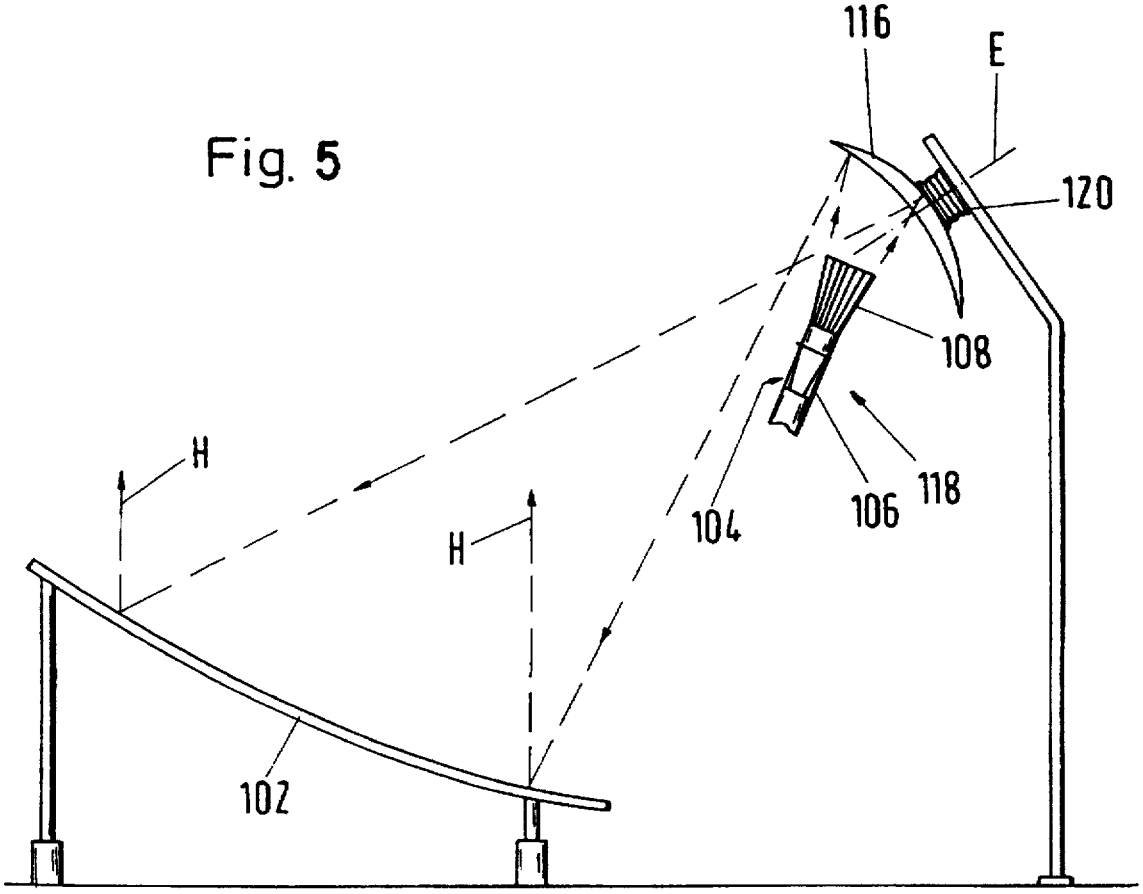

REFLECTOR ANTENNA, ESPECIALLY FOR A COMMUNICATIONS SATELLITE

BACKGROUND AND SUMMARY OF THE INVENTION

The invention relates to a reflector antenna of the type used for a communications satellite.

Reflector antennas with an elliptical lobe have been used heretofore for geostationary communications satellites, with the lobe being rotatable about an axis extending in the direction of the antenna beam in order to illuminate different coverage areas as desired. German Patent Document No. DE 39 39 318 A1, for example, discloses such an antenna which is rotatable on the satellite around the rotational axis of the elliptical lobe. This antenna, however, requires a considerable amount of space as well as construction and weight, which is contrary to the strict requirements of space travel in this regard.

In addition, a radar antenna with a fixed rectangular reflector and a feed horn that illuminates the reflector elliptically is disclosed in EP 0 236 160 B1. In this case, the horn is pivotable together with the associated feed section around the central axis of the reflector. Such an antenna design however, with full illumination of the reflector, permits a pivoting movement of the elliptical radiation diagram that is limited to a few degrees of angle. Therefore, it is unsuitable for the application described above, which requires essentially unlimited rotatability of the elliptical illuminating lobe.

The known reflector antennas also have the significant disadvantage that the polarization direction is rotated together with the rotation of the elliptical lobe, while the ground stations of communications satellites are set to a fixed polarization direction. Therefore, such deviation from the set polarization direction results in a marked deterioration of transmission quality.

Therefore, it is an object of the present invention to provide a reflector antenna of the species recited at the outset which is mechanically simple and compact. Another object of the invention is to provide a reflector antenna which has an electrical lobe that is completely rotatable around the radiation direction, without the polarization direction rotating along with the elliptical lobe.

This goal is achieved according to the invention by an arrangement of a single rotatable antenna element combined with a fixed feed section and a fixed round reflector. The circular radiation diagram of the feed section is converted in a structurally very simple, weight and space saving fashion into a variable elliptical radiation lobe which can be rotated without limit, while at the same time the polarization direction is retained independently of the rotation of the antenna element. The reflector antenna according to the invention is therefore highly suitable for the application described at the outset; that is, a geostationary communications satellite for illuminating optionally different receiving areas, with a radiation lobe that is constant in terms of both polarization direction and ellipticity.

In another advantageous embodiment of the invention, the antenna is designed in a structurally simple fashion as a double reflector antenna, with a plane auxiliary reflector located in the beam path between the elliptical horn radiator and the fixed main reflector.

To permit adjusting the reflector antenna to accommodate changed illumination requirements without replacing the auxiliary reflector, the auxiliary reflector preferably has a variable reflecting surface configuration.

In another embodiment, the antenna is designed preferably as an offset antenna for good performance data.

According to another feature of the invention, the fixed reflector can be designed as a lattice reflector which can be illuminated in each polarization direction by a separate feed system including a horn radiator or auxiliary reflector. Moreover, it is also possible to use for this purpose only a single-feed system and to provide one cross-polar-compensated surface geometry for the main and auxiliary reflectors.

Finally, the main reflector is advantageously mounted to be pivotable so that the elliptical lobe not only rotates around an axis that extends in the radiation direction but additionally can be pivoted perpendicularly thereto, so that the receiving area that can be illuminated by the antenna is further increased.

Other objects, advantages and novel features of the present invention will become apparent from the following detailed description of the invention when considered in conjunction with the accompanying drawings.

BRIEF DESCRIPTION OF THE DRAWINGS

FIG. 1 shows an offset reflector antenna according to the invention, with an elliptical horn radiator;

FIGS. 2(*a–c*) are diagrams which show the cross-sectional configuration of the feed section of FIG. 1;

FIG. 3 is a top view of the antenna in FIG. 1;

FIG. 4 is a modified embodiment of the antenna in FIG. 1, with an additional auxiliary reflector;

FIG. 5 is a multiple reflector antenna according to the second version of the invention.

DETAILED DESCRIPTION OF THE DRAWINGS

Figure 6:
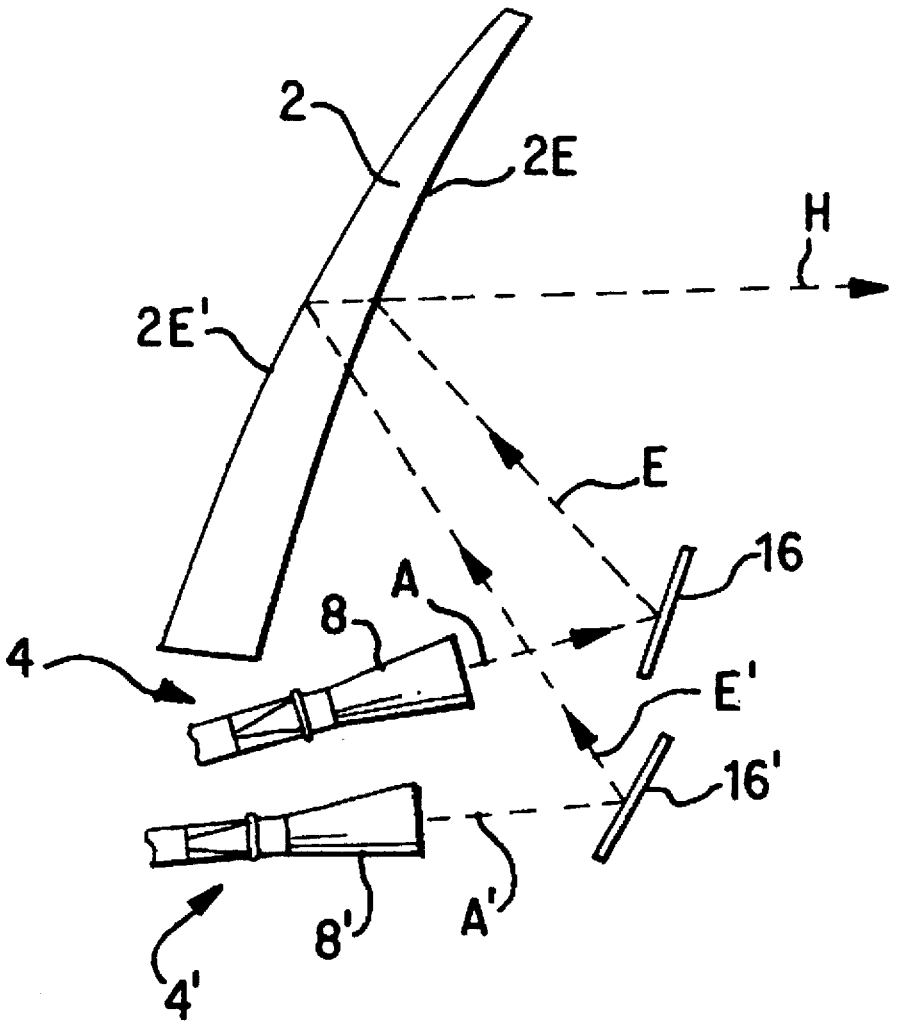
FIG. 6 is a schematic diagram of a second embodiment of the invention having two feed systems.

The offset reflector antenna shown in FIGS. 1 and 3 contains as its main component a fixed circular reflector 2, with a fixed feed section 4. The feed section 4 includes a transition section 6 with a rectangular inlet cross section a and a circular outlet cross section b, as shown in FIG. 2. A horn radiator in the form of a fluted horn 8 converts the circular radiation diagram b into an elliptical diagram c. The horn 8 is located so that it is rotatable around the lengthwise axis A, and is connected to the transition part 6 by a rotary coupling 12 in the vicinity of the circular horn section 10. The elliptical radiation diagram of fluted horn 8 is emitted by reflector 2 in the form of an elliptical lobe 14 (FIG. 3) which, depending on the rotational position of fluted horn 8, is rotationally adjustable without limit around an axis that runs in the main radiation direction H of reflector 2. The spatial polarization alignment and ellipticity of radiation lobe 14 however remain unaffected by the rotation of elliptical fluted horn 8.

In addition, the antenna can be mounted to be pivotable around at least one axis perpendicular to radiation direction H (not shown) in order to increase further the reception area covered by the antenna.

FIG. 4 shows a modified embodiment of the antenna according to FIG. 1, with a double reflector offset antenna. In this embodiment, a plane auxiliary reflector 16 is positioned in the beam path between fluted horn 8 and main reflector 2. Otherwise, the construction and function of the antenna shown in FIG. 4 is the same as in the first embodiment, and the elements that correspond to one another are marked by the same reference numerals.

The embodiment of the in FIG. 5 is also designed with a fixed, circular main reflector 102 and an auxiliary reflector 116, with a feed system 118 that includes a transition part 106 and a fluted horn 108. In contrast to the embodiments described above, however, fluted horn 108 is mounted in a fixed position, and has an essentially circular radiation diagram, while auxiliary reflector 116 is shaped as a section of a non-rotationally symmetric ellipsoid with a low numerical eccentricity. The auxiliary reflector 116 is rotatable by means of a drive motor 120 around an ellipsoid axis E (dot-dash line), so that it changes the circular radiation diagram of fluted horn 108 into an elliptical illumination of main reflector 102 that is rotatable in accordance with the rotational position of auxiliary reflector 116. Thus, as in the two previous embodiments, the spatial polarization, alignment, and ellipticity of the transmitted signal remain essentially unchanged when the radiation lobe is rotated.

To adjust to changed illumination requirements, auxiliary reflector 116 can have a reconfigurable ellipsoid shape. In addition, provision can be made for pivoting the radiation lobe by a pivotable arrangement of main reflector 102 around at least one axis perpendicular to main radiation direction H.

To suppress the components of the electric field vector normal to the desired components of the polarized signal emitted by the antenna ("cross polars"), the main and auxiliary reflectors have a cross-polar-compensated surface geometry. Optionally, it is also possible to make the main reflector 2 or 102 as a polarization-selective lattice reflector for linear polarization with low cross polars, and to radiate in each polarization direction using a separate feed system 4, 8, or 118, as shown in FIG. 6. An auxiliary reflector 16 or 116 with a rotationally variable elliptical radiation diagram that is fixed with respect to the polarization direction can also be provided.

FIG. 6 illustrates an embodiment of the invention having first and second feed systems 4,8 and 4',8', as referred to above. In addition, first and second auxiliary reflectors 16 and 16' are provided, and the main reflector 2 is structured as a lattice reflector, as noted previously, with reflector parts **2*e* and 2*e'***.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Reflector antenna comprising: at least a main reflector with a round aperture;

a fixed feed section having a fixed position and orientation, as well as a fixed polarization direction, relative to said main reflector; and a horn radiator rotatably coupled to said fixed feed section, for emitting radiation from said fixed feed section, which radiation is reflected by said main reflector;

said horn radiator having an elliptical output radiation pattern, and being rotatable relative to said fixed feed section about a longitudinal axis thereof.

2. Reflector antenna according to claim 1, wherein said antenna is a satellite antenna for communicating with space borne satellites.

3. Reflector antenna according to claim 1, further comprising a planar auxiliary reflector elliptically illuminated by horn radiator.

4. Multiple reflector antenna comprising:

a main reflector with a substantially circular aperture;

a fixed feed system including a horn radiator which generates a rotationally symmetric radiation diagram, with a fixed polarization direction; and at least one auxiliary reflector for reflecting a radiation pattern from said fixed feed system onto said main reflector; wherein:

the auxiliary reflector has a reflecting surface shaped as a partial surface of a rotationally nonsymmetric ellipsoid with a low numerical eccentricity;

the auxiliary reflector is rotatable about a main axis thereof; and the auxiliary reflector illuminates the main reflector elliptically with an ellipticity that is substantially constant regardless of a rotational position of said auxiliary reflector.

5. Reflector antenna according to claim 4, wherein said reflector antenna is a satellite communications antenna.

6. Reflector antenna according to claim 4, wherein the reflecting surface of the auxiliary reflector can be variably configured to accommodate varying illumination requirements.

7. Reflector antenna according to claim 4 wherein said reflectors have a cross-polar-compensated surface geometry.

8. Reflector antenna according to claim 4, wherein the main reflector is pivotable for pivoting an elliptical lobe around at least one axis that is perpendicular to radiation direction.

9. A reflector antenna comprising:

at least a main reflector having a double grid structure;

first and second feed systems, each of said feed systems having a fixed feed section with a fixed position and a fixed polarization direction relative to said main reflector, said fixed polarization direction of said feed section of said first feed system being different from said fixed polarization direction of said feed section of said second feed system; and a horn radiator rotatably coupled to said fixed feed section, for emitting radiation from said fixed feed section, which radiation is reflected by said main reflector, said horn radiator having an elliptical output radiation pattern, and being rotatable relative to said fixed feed section about a longitudinal axis thereof.

10. Reflector antenna according to claim 9, further comprising an auxiliary reflector for each of said systems.

* * * * *